US006165057A

United States Patent [19]

Gill, Jr.

[11] Patent Number: 6,165,057

[45] Date of Patent: Dec. 26, 2000

[54] APPARATUS FOR LOCALIZED PLANARIZATION OF SEMICONDUCTOR WAFER SURFACE

[76] Inventor: Gerald L. Gill, Jr., 1812 Peaceful Mesa, Prescott, Ariz. 86301

[21] Appl. No.: 09/079,624

[22] Filed: May 15, 1998

[51] Int. Cl.[7] ..... B24B 29/00

[52] U.S. Cl. ..... 451/287; 451/290

[58] Field of Search ..... 451/8, 41, 504, 451/287, 290, 163, 174, 340, 360, 259, 548, 495, 913

[56] References Cited

U.S. PATENT DOCUMENTS

| | | | |
|---|---|---|---|
| 4,894,957 | 1/1990 | Lladze et al. | 51/131.1 |
| 4,986,664 | 1/1991 | Lovoi | 356/376 |
| 5,077,941 | 1/1992 | Whitney | 51/165.71 |
| 5,643,053 | 7/1997 | Shendon | 451/28 |
| 5,718,619 | 2/1998 | Merrill et al. | 451/41 |
| 5,733,175 | 3/1998 | Leach | 451/41 |
| 5,762,546 | 6/1998 | James et al. | 451/504 |
| 5,827,111 | 10/1998 | Ball | 451/14 |
| 5,895,311 | 4/1999 | Shiotani et al. | 451/5 |

*Primary Examiner*—Timothy V. Eley
*Assistant Examiner*—Dung Van Nguyen
*Attorney, Agent, or Firm*—Tod R. Nissle, P.C.

[57] ABSTRACT

Apparatus for selectively polishing an elevated area of the surface of a semiconductor wafer. The apparatus makes a topographical map of the surface of a semiconductor wafer to identify a high area on the surface; positions polishing apparatus over and in contact with the elevated area; and, moves the polishing apparatus and/or the wafer to polish selectively only the elevated area of the wafer surface.

2 Claims, 4 Drawing Sheets

APPARATUS FOR LOCALIZED PLANARIZATION OF SEMICONDUCTOR WAFER SURFACE

This invention relates to apparatus for polishing semiconductor wafers.

More particularly, the invention relates to polishing apparatus both for identifying and polishing high areas on the surface of a semiconductor wafer and for polishing a wafer after semiconductors or other devices are mounted on or incorporated in the wafer.

In a further respect, the invention relates to apparatus for producing a topographical map of the surface of a wafer and for correlating elevated areas on the surface to a reference point to enable later location of the elevated areas during polishing.

In another respect, the invention relates to apparatus for polishing a localized area on the surface of a wafer by oscillating a polishing head with respect to the wafer surface, or vice-versa.

During planarization of a semiconductor wafer or other wafer, the surface of the wafer is polished flat to produce a surface deviation typically in the range of about 0.1 to 4.0 microns. Equipment for obtaining such a small surface deviation is well known in the art and will not be detailed herein. What apparently is not, however, known in the art is apparatus which facilitates the localized polishing of high elevations on the polished surface of a wafer. Eliminating high elevations on the surface of a wafer would produce a wafer surface having even less deviation.

Accordingly, it would be highly desirable to provide an improved polishing process which would facilitate the elimination of elevated areas on the surface of a semiconductor or other wafer.

Therefore, it is a principal object of the invention to provide an improved process and apparatus for polishing wafers of a material.

Another object of the invention is to provide an improved polishing process and apparatus for removing elevated areas on the surface of a planarized wafer.

A further object of the invention is to provide an improved polishing process and apparatus for removing elevated areas on the surface of a wafer which includes semiconductors or other devices mounted on or integrated in the wafer.

These and other further and more specific objects and advantages of the invention will be apparent to those skilled in the art from the following detailed description thereof, take in conjunction with the drawings, in which.

Briefly, in accordance with my invention, I provide an improved apparatus for polishing selected high areas on the surface of a semiconductor wafer. The apparatus includes apparatus for preparing a topographical map of at least a portion of the surface of the wafer to identify an elevated area on the surface; apparatus for polishing only a portion of the surface of the wafer; apparatus for positioning the polishing apparatus over and contacting a section of the elevated area; and, apparatus for moving at least one of the polishing apparatus and the wafer such that the polishing apparatus polishes the elevated area of the wafer.

In another embodiment of my invention, I provide apparatus for polishing selected high areas on the surface of a semiconductor wafer. The apparatus includes apparatus for preparing a topographical map of at least a portion of the surface of the wafer to identify an elevated area on the surface; polishing apparatus for polishing only a portion of the surface of the wafer, the polishing apparatus including an arcuate polishing surface; apparatus for positioning the polishing apparatus over and contacting a section of the elevated area with the arcuate polishing surface; and, apparatus for oscillating at least one of the polishing apparatus and the wafer such that the polishing apparatus polishes the elevated area of the wafer.

In a further embodiment of my invention, I provide apparatus for polishing selected high areas on the surface of a semiconductor wafer. The apparatus includes equipment for preparing a topographical map of at least a portion of the surface of the wafer to identify an elevated area on the surface; polishing apparatus for polishing only a portion of the surface of the wafer, the polishing apparatus including an arcuate polishing surface; apparatus for altering the curvature of the arcuate polishing surface; apparatus for altering the orientation of the arcuate polishing surface with respect to the surface of the wafer; apparatus for positioning the polishing apparatus over and contacting a section of the elevated area with the arcuate polishing surface; and, apparatus for moving at least one of the polishing means and the wafer such that the polishing means polishes the elevated area of the wafer.

Figure 1:
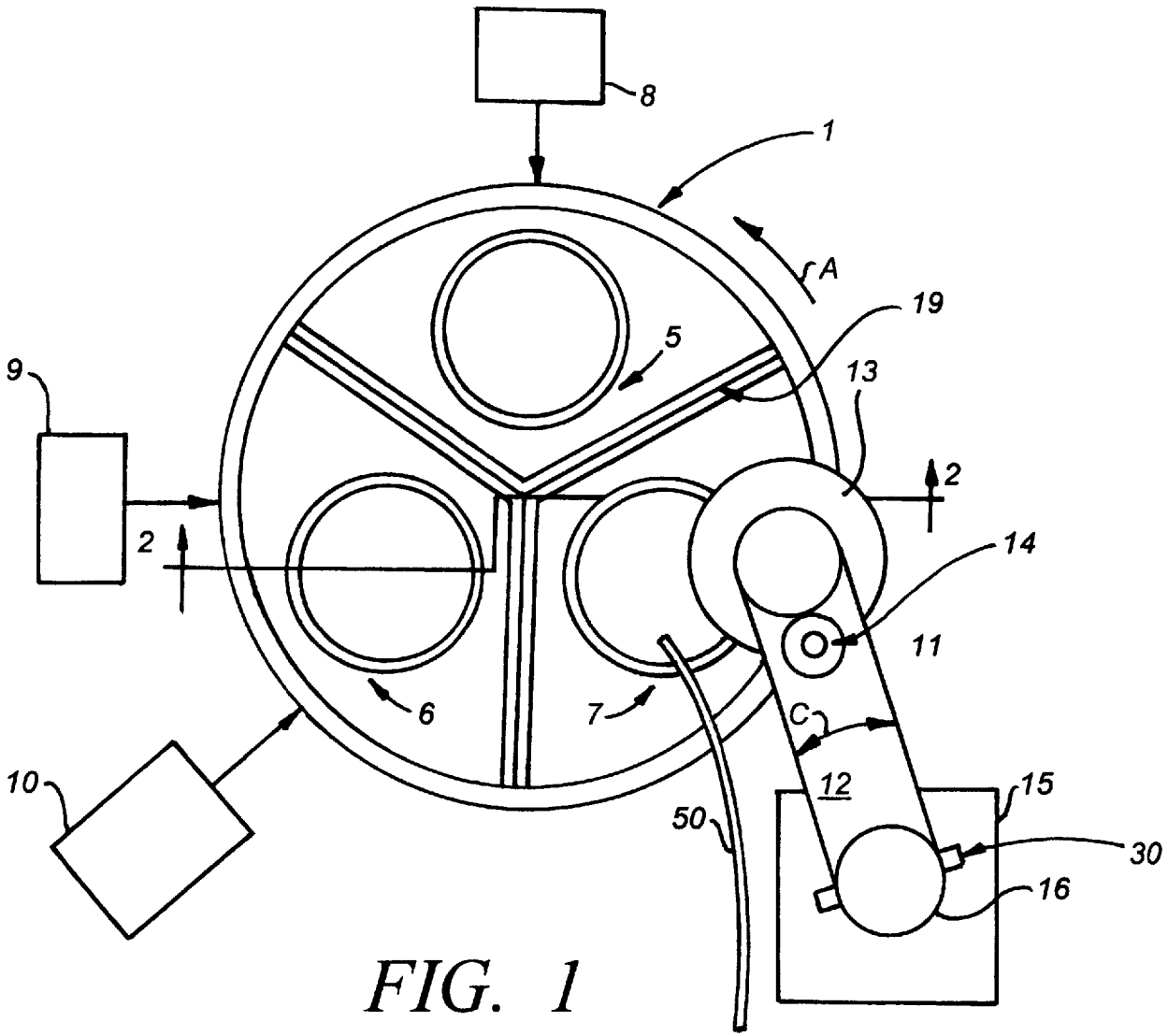
FIG. 1 is a top view illustrating wafer polishing apparatus constructed in accordance with the invention.
Figure 3:
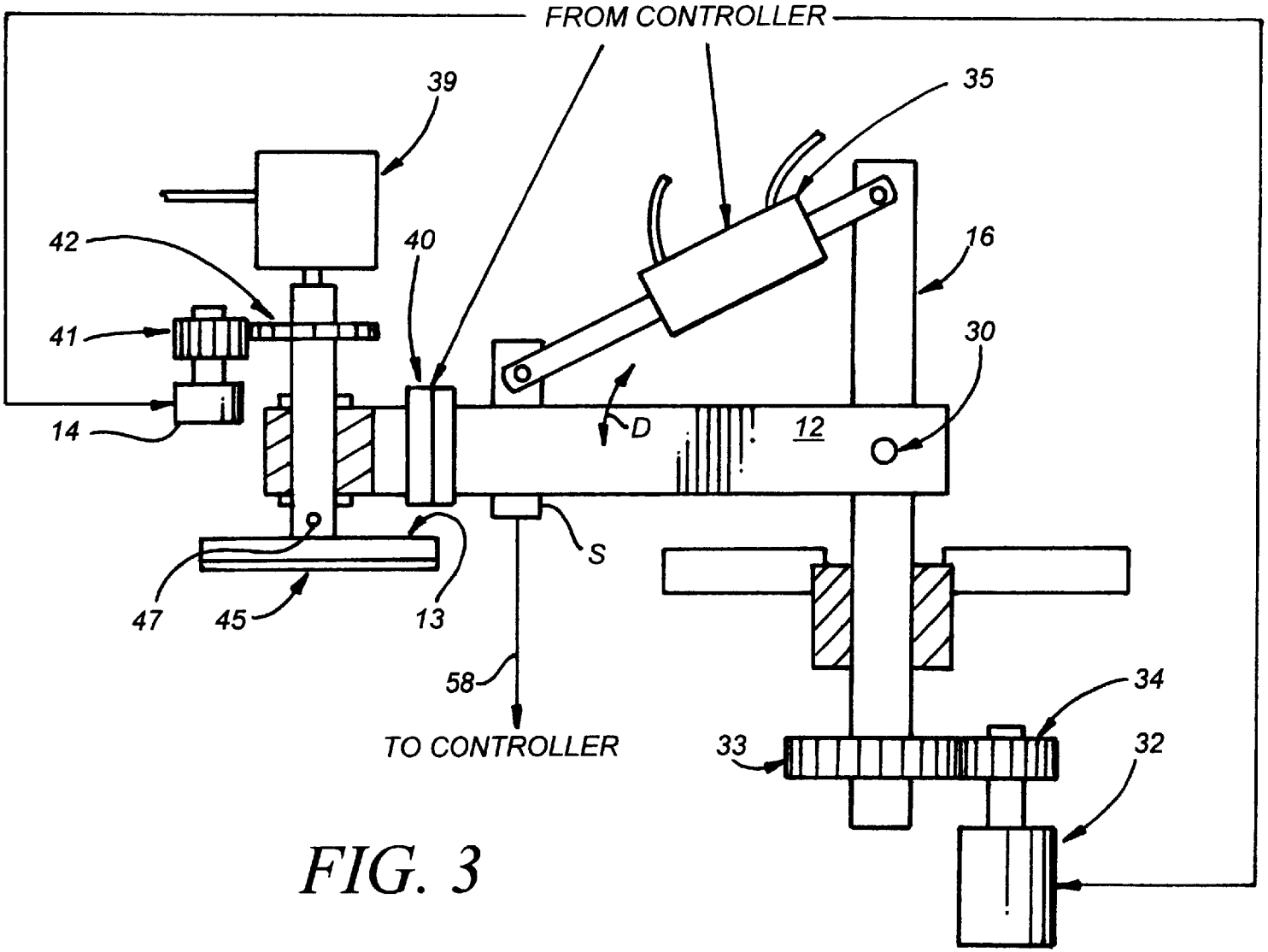
FIG. 3 is a side partial section view of the polishing arm assembly of FIG. 1; and, FIG. 4 is a side section view of the polishing head and a platen in FIG. 1 illustrating the mode of operation thereof.
Figure 4:
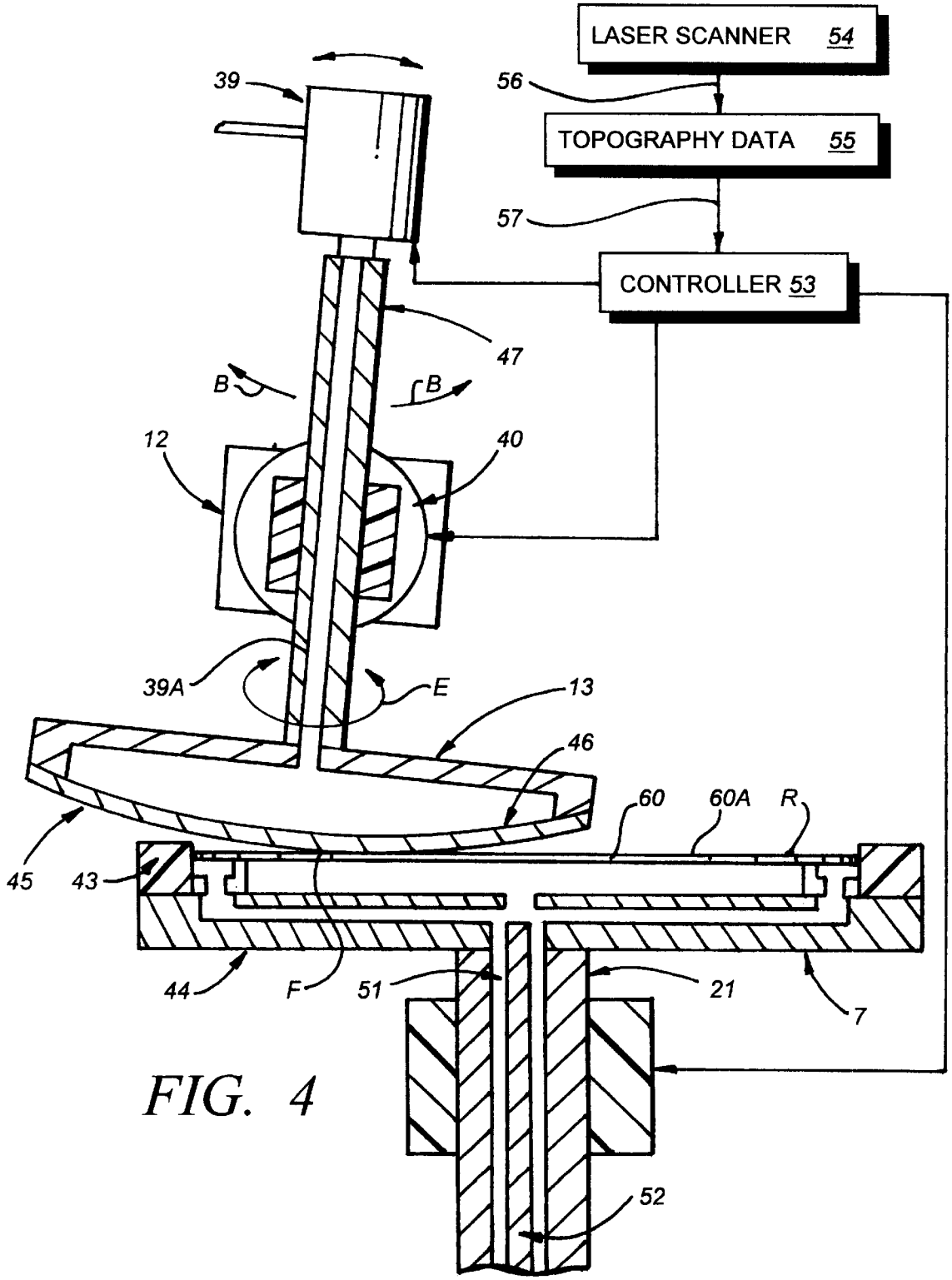

Turning now to the drawings, which depict the presently preferred embodiments of the invention for purposes of illustrating the invention and not by way of limitation of the scope of the invention, FIG. 1 illustrates a table 1 which can be turned or indexed in the direction of arrow A. Three circular platens 5 to 7 are rotatably mounted on table 1. In FIG. 1, platen 7 is in the four o'clock position, platen 5 is in the twelve o'clock position, and platen 6 is in the eight o'clock position. When a platen 5 to 7 is in the twelve o'clock position, cleaning station 8 can clean a wafer 60 on the platen. When a platen 5 to 7 is in the eight o'clock position, a wafer can be loaded onto or unloaded from the platen by load-unload station 10. When a platen 5 to 7 is in the four o'clock position, a wafer 60 on the platen can be selectively polished by a rotating polishing pad 45 mounted on a polishing head 13. The polishing pad 45 extends over a diaphragm 46 which is inflated and deflated to alter the curvature of the diaphragm and of the pad 45 adjacent the diaphragm. Diaphragm 46 and pad 45 are mounted on a rotating polishing head 13. Head 13 is attached to shaft 47 (FIGS. 3 and 4). In FIG. 4, universal joint 40 permits the cant or slope of vertical shaft 47 and of pad 45 with respect to a wafer 60 to be adjusted in the directions indicated by arrows B. Shaft 47 is rotatably mounted on arm 12 of polishing assembly 11.

Load station 9 includes a laser topography system for determining the topography of the surface 60A of wafer 60 to be polished by pad 45. Any desired system or apparatus can be utilized to measure and produce a topographical map of surface 60A. If desired, the apparatus for producing a topographical map of surface 60A can be separate from station 9. In order to locate a particular high or elevated area on 60A after the topographical map of surface 60A is produced, one or more reference points R are utilized. Such reference points ordinarily are on wafer 60; however, it is possible that a reference point may be utilized on a holder on which wafer 60 is mounted when the position of wafer 60 on and with respect to the holder is fixed. By way of example and not limitation, a reference point R may be on surface 60A in the center of an elevated area, or may be on the periphery of a wafer 60. Each reference point is correlated to the points on the topographical map of surface 60A such that once the appropriate reference point(s) on a wafer 60 or on a wafer holder is identified the location of each point (and of the elevated areas) in the topographical map of surface 60A with respect to the reference point is known.

The laser scanner 54 produces 56 data 55 defining the topography of surface 60A. Any other desired surface measurement tool or apparatus can be utilized in place of or in conjunction with scanner 54. Data 55 is preferably in digital form and is transmitted 57 to and stored in the memory of a controller 53. Controller 53 comprises a microprocessor or other computer having a memory. Controller 53 also receives data from a scanner S (e.g. an optical scanner or any other desired scanner or sensor). Scanner S detects one or more reference points on wafer 60 or on apparatus in which wafer 60 is mounted. Once the reference point(s) detected by scanner S is transmitted 58 to controller 53, controller 53 uses the reference point and the topography data to determine the location of an elevated area F on wafer 60. After the location of an elevated area E is determined, the controller 53 operates piston 35 (to pivot arm 12 up and down about pivot 30), motor 32 (to turn, via gears 33 and 34, shaft 16 and arm 12 laterally in the directions indicated by arrows C in FIG. 1), and rotational joint 40 (to pivot arm 47 about the centerline of arm 12 in the directions indicated by arrows B and in a vertically oriented plane which passes through the centerline of shaft 47 and is parallel to centerline of shaft 16) to position arm 47 and pad 45 such that pad 45 only contacts surface 60A within a selected elevated area F on surface 60A and such that pad 45 only moves within the selected elevated area F. Controller 53 also operates motor 14 (to turn, via gears 41 and 42, shaft 47 and pad 45 in the directions indicated by arrows E), vacuum-pressure pump 39 (to inflate and deflate, via cylindrical aperture 39A in shaft 47, bladder 46), and a motor to turn (like motor 24 turns shaft 21A via gears 25 and 26) shaft 21 and platen 7 carrying wafer 60. Motors 27 and 32, as well as the motors which turn each platen on table 1, each preferably provide data to controller 53 concerning the position of table 1, arm 12, and of the platens. Such position data is utilized by the controller 53 to adjust table 1, arm 12, and the platens in order to polish selected elevated areas on the surface 60A of a wafer 60.

When motor 14 rotates shaft 47 and pad 45 to polish an elevated area on surface 60A, shaft 47 and pad 45 oscillate back and forth such that pad 45 contacts and moves back and forth over surface 60A along a line or swath within the selected elevated area F. One way to oscillate pad 45 over surface 60A is to oscillate arm 12 in the directions indicated by arrows C in FIG. 1. Another way to oscillate pad 45 over surface 60A is to use rotational joint 40 to rotate arm 47 (and pad 45) back and forth in the directions indicated by arrows B in FIG. 4. Another way to oscillate surface 60A with respect to pad 45 is to utilize motor 24 to oscillate spindle 21 and platen 7 back and forth through a short arc such that pad 45 continues to contact surface 60A only within the elevated area.

In FIG. 1, vertically oriented shaft 16 pivots in stationary bushing 31 mounted in collar 15. Pad 45 is mounted on base 13. Tube 50 delivers slurry, water, or other polishing agents or fluids to surface 60A of a wafer mounted on platen 7.

Figure 2:
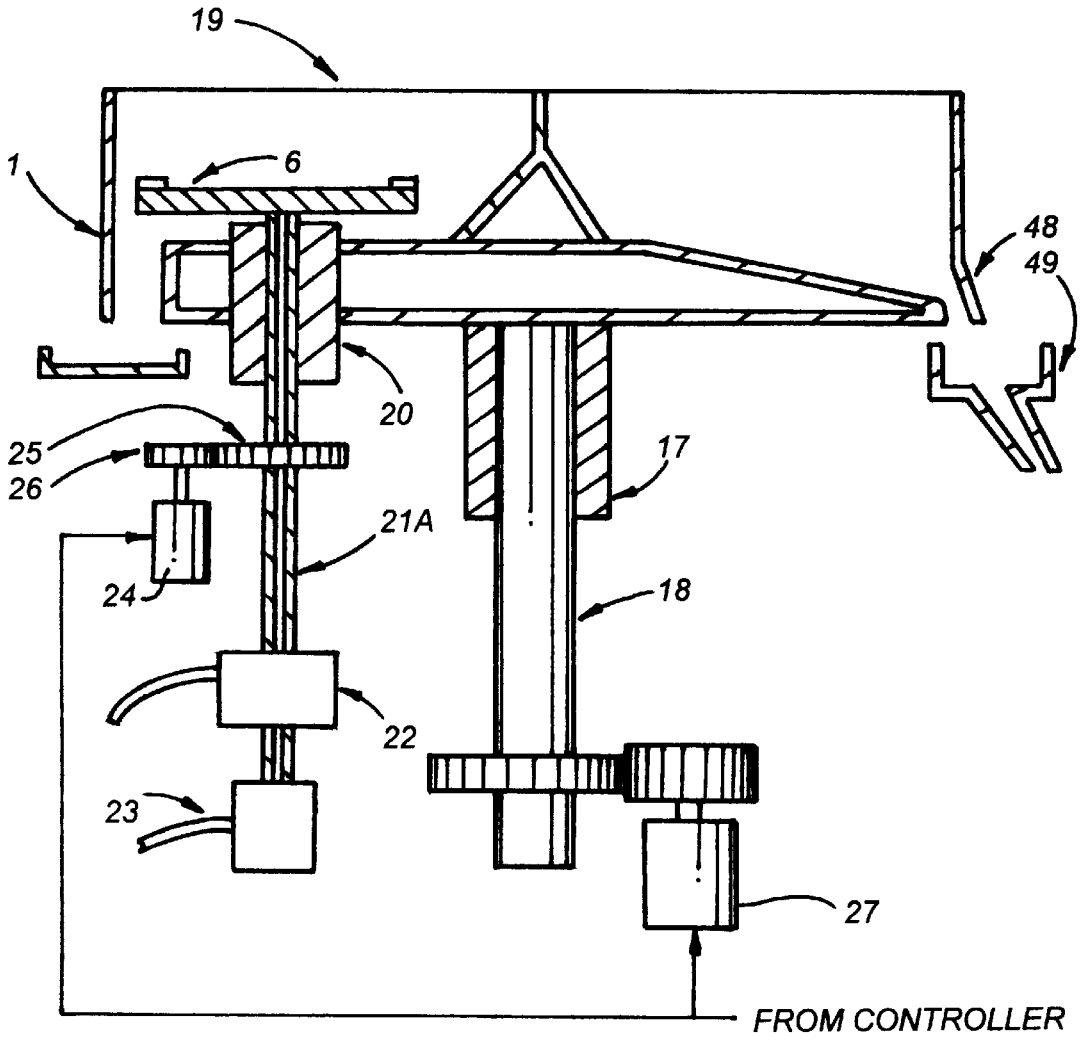
FIG. 2 is a side section view of the table of apparatus of FIG. 1 taken along section line 2—2 thereof.

In FIG. 2, shaft 18 turns in stationary bushing 17. Table 1 is mounted on shaft 18. Excess slurry flows through opening 48 of housing 19 into sink 49. Shaft 21A rotates in stationary bushing 20. Platen 6 is mounted on and rotates simultaneously with shaft 21A. Vacuum unit 22, 23 produces a vacuum through a hollow channel in shaft 21A to hold a wafer on platen 6. Unit 22 can pump water through a hollow channel in shaft 21A to separate a wafer from platen 6.

In FIG. 4, a vacuum-pressure unit (not visible) similar to unit 22, 23 produces a vacuum via hollow channels 51 and 52 in shaft 21 to produce suction which holds the outside edge of wafer 60 in position within circular lip 43 on base 44. The vacuum-pressure unit can also produce air pressure within channels 51 and 52 which functions to release wafer 60 from platen 7 and to force wafer 60 outwardly away from base 44.

Inflating bladder 46 decreases the radius of curvature of the outer surface of pad 45 so that pad 45 tends to have more of a point contact with surface 60A. Deflating bladder 46 increases the radius of curvature of the outer surface of pad 45 and makes pad 45 flatter, tending to cause pad 45 to contact surface 60A over a greater area of surface 60A.

While the portion of the total area of surface 60A polished by pad 45 can vary as desired, the area typically is usually less than about two squares inches, and typically is in the range of about one-eighth to one-half square inch.

In one preferred embodiment of the invention, a truncated conical surface is formed in and extends through the thickness of the wafer 60. The conical surface is a different color than, or can otherwise be differentiated from, the semiconductor material surrounding and immediately adjacent the conical surface. Planar surface 60A intersects the conical surface at points defining a first circle; consequently, a first circular image is viewed on surface 60A. When material is removed from surface 60A by polishing to produce a first new surface having an elevation lower than that of the original surface 60A, the diameter of the circle visible on the first new surface is greater (or less) than the diameter of the circle on the original surface 60A because the first new surface intersects the conical surface at points defining a second circle having a diameter larger than the diameter of the first circle (this occurs because the concial surface is diverging as it extends into and through the wafer). When more wafer material is removed from the first new surface by polishing to produce a second new surface, the diameter of the circle which is visible on the second new surface is greater than that of the circle on the first new surface because the second new surface intersects the conical surface at points defining a third circle having a diameter larger than that of the second circle. And so on. Any desired reference marks other than the conical surface just described can be utilized to enable an operator to visually ascertain when surface 60A has been polished enough to produce a desired wafer thickness.

Wafers 60 polished in accordance with the apparatus of the invention include semiconductor wafers or wafers made from other materials and include semiconductor wafers or other wafers having semiconductors or other devices formed or mounted on or embedded partially or completely in wafer 60.

In use, by way of example and not limitation, topography data 55 defining the topography of surface 60A of wafer 60 is generated 56 by laser scanner 54 in loading station 9. The topography data is transmitted 57 to the memory of controller 53, along with the location of reference point R with respect to each point on the surface 60A which defines the topography of surface 60A. One way of defining the location of reference point R is to define wafer 60 as having a circular periphery and to determine how far point R is from the periphery of wafer 60 when point R lies on a diameter line extending across wafer 60. Table 1 is rotated in the direction of arrow A until empty platen 7 is in the eight o'clock position in FIG. 1 (i.e., until platen 7 is in the position occupied by platen 6 in FIG. 1). Load station 9 loads wafer 60 onto platen 7 with surface 60A facing up in the manner illustrated in FIG. 4. Table 1 is indexed to move platen 7 to the four o'clock position illustrated in FIG. 1. When platen 7 is initially moved to the position shown in FIG. 1, pad 45 is positioned above and spaced apart from surface 60A. Once platen 7 reaches the position shown in FIG. 1, controller 53 orders motor 27 to stop to halt the rotation of table 1 in the direction of arrow A. Laser scanner S determines the location of reference point R (and/or of any other desired reference point(s)) and transmits this information to controller 53 to enable controller 53 to calculate correctly the orientation of the topography of surface 60A with respect to reference point R. Laser scanner S can be mounted at any desired location including, without limitation, on table 1 over platen 6. Any other desired measuring apparatus can be utilized in combination with or in place of scanner S to identify the topograph of a wafer 60. In some cases, it may be desirable to provide sophisticated measuring equipment at a platen 6 separate from the platen 7 at which wafer 60 is polished.

Once controller 53 determines the orientation of surface 60A, controller selects an elevated area F in surface 60A and, using piston 35 and motor 32 and joint 40, adjusts the position of pad 45 until pad 45 is directly over and contacting the elevated area F. Piston 35 can also be utilized to adjust the magnitude of the pressure which forces pad 45 against surface 60A. If necessary, controller 53 also commands a motor turning shaft 21 to turn shaft 21 and platen 7 until the elevated area F is positioned at a desired location beneath pad 45. While platen 7 and wafer 60 are maintained in fixed position, controller 53 operates motor 14 to rotate pad 45 in the direction of arrows B. Controller 53 also operates rotational joint 40 to oscillate pad 45 back and forth while pad 45 continues to contact surface 60A only in the elevated area F. As earlier noted, platen 7 and wafer 60 can also, simultaneously with the oscillation of pad 45 or without the oscillation of pad 45, be oscillated such that only said elevated area F continues to contact pad 45. After pad 45 polishes the elevated area F for a selected period of time, controller 53 causes piston 35 and arm 12 to lift pad 45 out of contact with wafer 60, after which sensor S scans surface 60A to determine of the elevated area E has been polished and flattened to reduce sufficiently the deviation of area E above and from other areas of surface 60A which are adjacent area E. If necessary, pad 45 can be again be directed by controller 53 to further polish area E, or controller 53 can select and polished another elevated area in surface 60A. After polishing of surface 60A is completed, controller 53 indexes table 1 in the direction of arrow A so platen 7 moves to the twelve o'clock position in FIG. 1 adjacent cleaning station 8. Station 8 cleans surface 60A. Controller 53 indexes table 1 in the direction of arrow A so platen 7 moves to the eight o'clock position in FIG. 1 adjacent load-unload station 9. Station 9 unloads the wafer 60 from platen 7.

Having described my invention in such terms as to enable those skilled in the art to understand and practice it, and having identified the presently preferred embodiments thereof, I claim:

1. Apparatus for polishing selected high areas on a planarized semiconductor wafer to flatten the wafer, the wafer having a surface, said apparatus including (a) means for preparing a topographical map of at least a portion of the surface of the wafer to identify an elevated area on the surface;

(b) rotating polishing means for polishing only a portion of the surface of the wafer, said polishing means including an arcuate polishing surface;

(c) means for positioning said polishing means over and contacting a section of said elevated area with said arcuate polishing surface; and, (d) means for oscillating laterally at least one of said polishing means and the wafer such that said polishing means polishes said elevated area of the wafer to flatten the wafer.

2. Apparatus for polishing selected high areas on a planarized semiconductor wafer to flatten the wafer, the wafer having a surface, said apparatus including (a) means for preparing a topographical map of at least a portion of the surface of the wafer to identify an elevated area on the surface;

(b) rotating polishing means for polishing only a portion of the surface of the wafer, said polishing means including an arcuate polishing surface;

(c) means for altering the curvature of said arcuate polishing surface;

(d) means for canting and altering the orientation of said arcuate polishing surface with respect to the surface of the wafer;

(e) means for positioning said polishing means over and contacting a section of said elevated area with said arcuate polishing surface; and, (f) means for moving and oscillating laterally at least one of said polishing means and the wafer such that said polishing means polishes said elevated area of the wafer to flatten the wafer.

* * * * *